United States Patent [19]

Grass

[11] Patent Number: 4,683,612

[45] Date of Patent: Aug. 4, 1987

[54] FURNITURE HINGE WITH A LATERAL AND DEPTH ADJUSTMENT FITTING

[76] Inventor: Alfred Grass, Konsumstrasse 20, Höchst/Vlbg., Austria, 6973

[21] Appl. No.: 785,434

[22] Filed: Oct. 8, 1985

[30] Foreign Application Priority Data

Oct. 8, 1984 [AT] Austria ..... 3175/84

[51] Int. Cl.[4] ..... E05D 7/06

[52] U.S. Cl. ..... 16/240; 16/246; 16/382

[58] Field of Search ..... 16/238, 245, 246, 382, 16/DIG. 39, 239, 240, 241, 370

[56] References Cited

U.S. PATENT DOCUMENTS 4,313,239 2/1982 Tsuneki ..... 16/241

FOREIGN PATENT DOCUMENTS 2406438 8/1975 Fed. Rep. of Germany ..... 16/245

593949 10/1947 United Kingdom ..... 16/238

*Primary Examiner*—Fred Silverberg

*Attorney, Agent, or Firm*—Sughrue, Mion, Zinn, Macpeak and Seas

[57] ABSTRACT

A furniture hinge for a door wing with a lateral and depth adjustment fitting. A base plate for attachment to a piece of furniture is adjustably connected to a hinge arm, and a pivot bearing is constructed on the free end of the hinge arm, whereby the inclination of the hinge arm is adjustable relative to the base plate by two fixing screws, each of which is capable of being screwed in to the furniture sidewall through holes in both the hinge arm and the base plate, thus restraining the base plate on the furniture sidewall. A pivot bearing formed by a lug bent up from the base plate embraces the free end of the hinge arm. Cams project from both sides of the base plate side faces in the region of the inclination adjusting screw. Due to the pivot bearing between the hinge arm and the base plate stability is achieved in which the loads and stresses acting on the longitudinal axis of the hinge arm are not only taken in the direction of the end furthest from the door wing but also in the direction of the door wing.

11 Claims, 3 Drawing Figures

FURNITURE HINGE WITH A LATERAL AND DEPTH ADJUSTMENT FITTING

BACKGROUND OF THE INVENTION

A furniture hinge mentioned in this introduction is already known by OE-P No. 228,195. Therein, the inclination-adjusting screw for lateral adjustment acts through the hinge arm on an intermediate plate, which is form-locking and depth adjustable in a guide between intermediate plate and base plate. The lateral adjustment is thereby achieved between hinge arm and base plate. Therefore, the pivot bearing necessary for the lateral adjustment is arranged between the hinge arm and the intermediate plate, whereby the hinge arm progressively covers the intermediate plate, and, in the region of the pivot bearing spans it, thereby the load of the door and other incidental structure are first carried by this intermediate plate.The load transfer from the intermediate plate to the base plate is achieved through the above mentioned depth adjustment guide which is firmly screwed to the body wall.

This has the disadvantage in that the load and stresses are not directly taken on the base plate but act through an intermediate element. Although the intermediate plate has, in itself, the advantage of the greatest depth adjustment possibilities, it is also thereby coupled with a loss of stability. Additionally the costs of a furniture hinge with intermediate plate are naturally considerably higher.

A further disadvantage is created in that the intermediate plate obstructs the holes in the base plate for the fixing screws which means that the furniture hinge cannot be supplied to the user with an assembled base plate. The base plate is supplied as a seperate part and has to be screwed onto the body. Only after this operation has been carried out can the hinge arm with the integral intermediate plate be slid onto it and secured. From Industry, i.e. the major users, the demand for a cheaper and, where possible, a more stable and easier assembled door hinge becomes even more acute. Thus by reason of fully automatic and precision hinge drilling and fitting machines, the large adjustments, particularly in depth and height, can be extensively dispensed with.

BRIEF SUMMARY OF THE INVENTION

The invention takes as its basis the production of a furniture hinge, of the type mentioned in the introduction, which avoids the above mentioned disadvantages, which means having great stability at a minimum price, allowing simplified dispatch together with a more rational assembly. These problems will be solved according to this invention in that the pivot bearing is formed, on the one side, by a lug bent up from the base plate which embraces the free end of the hinge arm, and on the other side, from both sides of the base plate side faces in the area of the inclination-adjusting protruding cam, which engage in guide slots in the hinge side walls in a sliding fashion,whereby the middle position of inclination of the fixing screws in the hinge arm is maintained and the base plate is maintained and guided in the screwing-in position.

The base plate is thereby an integral part of the furniture hinge and therefore on the one hand does not have to be supplied seperately and, on the other hand, the vertical load and other stresses are carried direct from the hinge arm to the base plate, without an intermediate plate, and from there to the body wall.

Due to the pivot bearing, according to the invention, between the hinge arm and the base plate, a remarkably high stability is achieved,in that the loads and stresses acting on the longitudinal axis of the hinge arm are not only taken in the direction of the end furthest from the door wing but also in the direction of the door wing. A problem-free lateral adjustment by inclination displacement is guaranteed with this pivot bearing. This is achieved by one inclination-adjusting screw and a spring element which is situated between the hinge arm and base plate, as known.

An even more stable connection between hinge arm and base plate is thereby achieved in that the hinge arm is pressed, under load, into that part of the base plate which forms the other part of the pivot bearing and, likewise, a light loading exists between this pivot bearing and the cam engaging in the guide slots in the side wall of the hinge arm. The base plate which fits tightly in the hinge arm thereby contributes to the overall stability A spring element of rubber, plastic such as polyurethane foam, or spring steel can be fitted in compression around the inclination- adjusting screw between the base plate and the hinge arm. In addition to the unidirectional adjustment loading such a spring element also contributes vibration- damping qualities. A further degree of extra stabilizing and damping is particularly achieved by the high contact pressure of the plastic pads on the undersides of the hinge arm and base plate.

Facing the base plate attachment holes are holes in the hinge arm covering wall in which the fixing screw heads are a tight fit. The fixing screws are fitted in these holes by the supplier, that is the screw head is pressed into the hinge holes until the screw shafts project through the fixing holes in the base plate which guides and holds them in position. Advantageously, for the purpose of centralizing in the holes in the furniture, the threaded portions of the screws protrude a short way through the underside of the base plate.

In this way the fixing screws are integrated with the furniture hinge and are so received by the user. The inclination of the hinge arm is then in the middle position. It is now possible to automatically fit the hinges into the pre.drilled holes and secure in one work stage. During the fitting of the doors, adjustment of the inclination to either side, using the inclination adjusting screws, and likewise depth adjustment by loosening the fixing screws and sliding the furniture hinge with base plate in the through-holes, can be carried out as necessary.

The invention is now further explained by means of the attached drawings, from which arise further important features.

BRIEF DESCRIPTION OF DRAWING VIEWS

DETAILED DESCRIPTION

Figure 1:
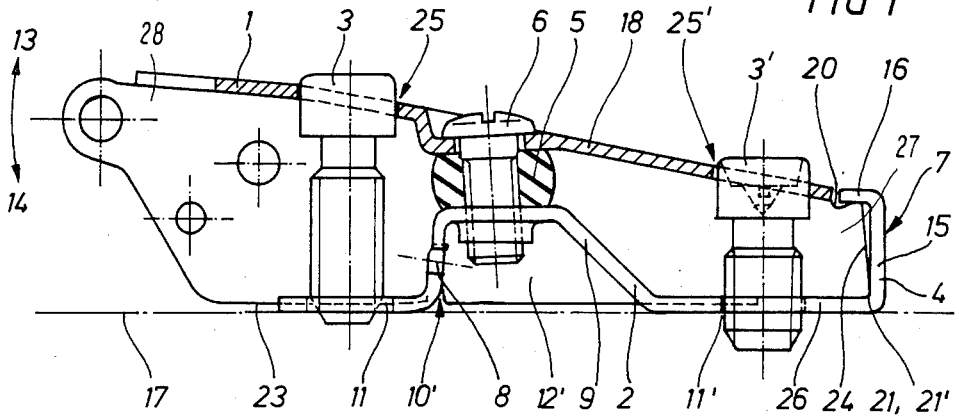
FIG. 1 is a longitudinal section through a type of furniture hinge according to the invention in the minimum inclination position(lateral adjustment) wherein the otherwise visible base plate is not illustrated.

The special design of the hinge arm(1) is shown in FIG. 1, which, together with the base plate(2) forms an integrated unit in which, on the end of the base plate(2) furthest from the door wing end, a U-shaped lug(4) is formed. The lug is shown to be engaged with the free end (27) of the hinge arm, which is longitudinally opposed from the door wing end (28). Thereto the first leg(15) is bent at right angles to a fixing or supporting surface(17) and the second leg(16) is bent parallel to the fixing surface(17) and directed towards the door wing end. Thereby, a bearing pocket is created in the rear end of the base plate(2) for the pivot bearing(7). Likewise FIG. 1 shows that the sidewalls(12) (12')of the hinge arm(1) on the end furthest from the door wing end protrude above the hinge arm covering wall(18) and engage in the bearing pocket of the pivot bearing(7). The upper surface (20) of the protruding side wall parts , for this purpose, designed to rotate about the joints(21)(21') which are formed by the edges of the recess (22) and the lightly pointed and tilted rear face(24). This assures that the hinge arm is adjustable about the joints (21)(21') in the direction of inclination(13)(14). Preferably, the size of the radii of the upper surfaces(20) is selected so as to achieve a lightly braced seating in the U-shaped bearing pocket of the pivot bearing(7).

Figure 2:
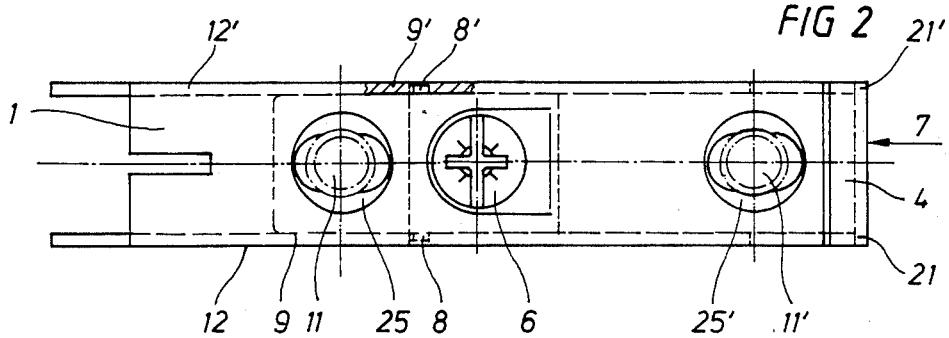
FIG. 2 is an overhead view of the furniture hinge in accordance with FIG. 1 without fixing screws.
Figure 3:
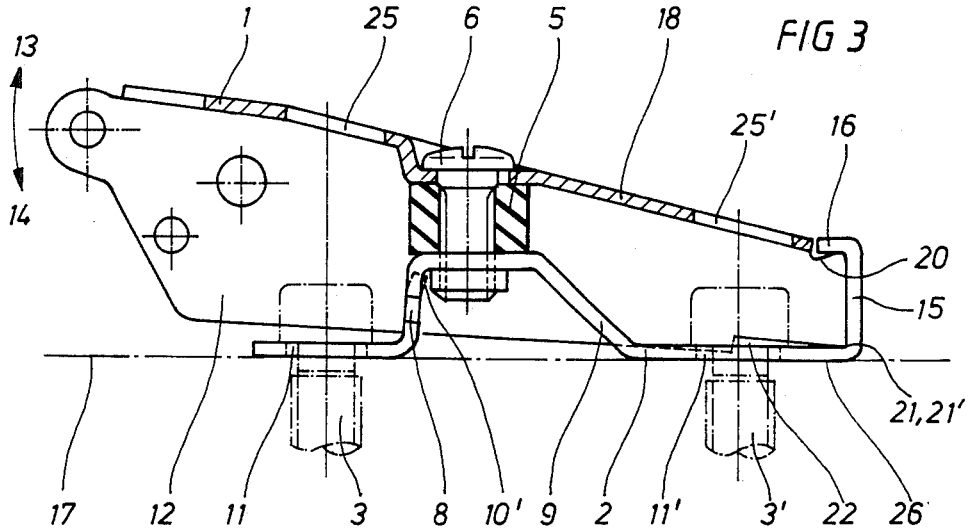
FIG. 3 is a longitudinal section as in FIG. 1 but in a position of sharp lateral correction adjustment.

FIG. 2 shows that the end of the base plate(2) furthest from the door wing forming the pivot bearing(7) has the same width as the hinge arm(1) which width extends over the longitudinal length of the recess (22) in the hinge arm(1). The width of the remaining area of extension of the base plate(2) together with the internal width of the side walls(12)(12') forms a sliding seating. It is advantageous when this seating is a good fit thus creating a stabilizing bracing effect.

In order that the hinge arm is also secured against movement in the direction of the door wing the cams(8)(8') are located on each base plate side face between the hinge arm sidewalls(12)(12') and engage in a sliding fashion and forming a positive lock in the guide slots(10)(10') in the hinge arm sidewalls(12)(12'). These cams(8)(8') can be of rectangular, square or round section and protrude to a maximum of the width of the hinge arm walls and sides.

The guide slots(10)(10') are curved, whereby the radius of the guide slots centers about the joints(21, 21'). The cams (8)(8') slide in the slots during inclination adjustment thus forming the abutment for the pivot bearing (7). It is therefore advantageous if a light bracing between the pivot bearing and the cam fitting is available which achieves an extra stabilizing effect between the hinge arm and the base plate.

A marked improvement in the stability is induced by the spring element(5) which is fitted in compression around the inclination-adjusting screw(6) between the hinge arm(1) and the base plate(2) and which induces a locking action of the inclination adjustment in direction(13) as the spring element is further compressed during inclination adjustment in direction(14) thus increasing the bracing effect. This bracing effect likewise induces an extra stability between the hinge arm(1) and the base plate(2). Materials such as rubber or polyurethane are particularly suitable due to their good damping qualities. However, spring elements from steel are also suitable for this task.

Two holes(25)(25') are provided in the hinge arm covering wall(18) which are co-axial with the fixing screw holes(11)(11) in the base plate(2), which have a tight fit with the heads of the fixing screws(3)(3'). The fixing screws are fitted in these holes by the supplier so that they protrude through the fixing holes (11)(11').The heads are self-locking in the holes(25)(25') while the shafts are guided by the fixing holes(11)(11'). The threaded portion protrudes a little way through the underside of the base plate thus advantageously serving as centralizing pins for the mounting of the furniture hinges.

In this fashion both of the fixing screws(3)(3') are an integral part of this furniture hinge and are delivered to the user in this pre-assembled state. Seperate purchase of, or seperate introduction during assembly of these screws is no longer necessary. Thus the complete hinge has no parts on the hinge arm side which require to be externally introduced for the assembly or adjustment.

I claim:

1. A furniture hinge with a lateral and depth adjustment fitting for a door wing, comprising:
   (a) a base plate (2) with elongated holes (11, 11') for attachment to a support surface (17) of a piece of furniture;
   (b) an inverted, U-shaped hinge arm (1) having a free end (27) opposite a door wing end (28) and disposed on the base plate and having pivot bearing means (7) securing on said free end of the hinge arm;
   (c) adjusting means to adjust the hinge arm inclination relative to the base plate comprising an adjustment screw (6) and a spring element (5), wherein the adjustment screw is inserted through the spring element and adjustably connects the hinge arm and base plate;
   (d) said pivot bearing means comprising a lug (4) formed on one end of the base plate and securing the free end of the hinge arm, wherein said lug is U-shaped and includes a first leg (15) contiguous with the base plate and approximately perpendicular thereto and a second (16) leg contiguous with said first leg and directed towards the door wing end in a parallel relation with the base plate; and
   (e) fixing screws (3, 3') inserted through holes (25, 25') in the hinge arm and into the elongated holes in the base plate to secure the base plate to the support surface.

2. A furniture hinge as recited in claim 1 further comprising; hinge side walls (12, 12') forming part of said hinge arm and extending downwardly therefrom, a recess (22) provided in an underside (23) of the hinge side walls and extending into the base plate from the free end, whereby the depth of the recess (22) is approximately the thickness of the base plate.

3. A furniture hinge as recited in claim 2, wherein the side walls (12, 12') of the hinge arm (2) at its end furthest from the door wing end (28) protrude above a hinge arm covering wall (18) and form an upper surface (20) which engages an end of the second leg and permits the hinge arm to rotate about the joints (21, 21'), wherein said joints are formed by edges of the side walls forming said recess (22) and a slightly pointed and tilted rear face (24) of the side walls (12, 12').

4. A furniture hinge as recited in claim 3 wherein the upper surface (20) has a radii which corresponds to the length of the first leg(15).

5. A furniture hinge as recited in claim 3 wherein guide slots (10, 10') with downwards-facing openings are provided in both hinge arm sidewalls (12, 12') whereby these guide slots (10, 10') are curved concentrically above the joints (21, 21').

6. A furniture hinge as recited in claim 1 wherein the width of the U-shaped lug (4) with the legs (15) (16) has the same width as the hinge arm (1).

7. A furniture hinge as recited in claim 6, wherein the width of the U-shaped lug (4) of the base plate extends over the length of the recess (22) in the hinge arm (1).

8. A furniture hinge as recited in claim 6 wherein the width of the base plate (2) extending from the lug to the door wing end (28) forms a tight sliding seating with an internal width of the hinge arm side walls .

9. A furniture hinge as recited in claim 1 wherein a cam (8, 8') is located on each base plate side face between the hinge arm side walls (12, 12'), and guide slots (10, 10') in the hinge side walls for slidingly engaging said cams.

10. A furniture hinge as recited in claim 1, wherein the fixing screws are sized to pass completely through holes (25, 25') in the hinge arm during assembly.

11. A furniture hinge as recited in claim 1 wherein threaded portions of the fixing screws (3, 3') are restrained and guided by the elongated fixing screws holes (11, 11') in a locating position, and the fixing screws are inserted into the elongated holes in the base plate but prohibited from passing completely therethrough because of enlarged heads on the screws.

* * * * *